US005623805A

United States Patent [19]

Morello

[11] Patent Number: 5,623,805

[45] Date of Patent: Apr. 29, 1997

[54] SEAMING DEVICE CAPABLE OF SEAMING CURVED AND STRAIGHT PANELS

[75] Inventor: Frederick Morello, Johnstown, Pa.

[73] Assignee: M.I.C. Industries, Inc., Reston, Va.

[21] Appl. No.: 425,439

[22] Filed: Apr. 20, 1995

[51] Int. Cl.[6] ..... E04D 15/00

[52] U.S. Cl. ..... 52/749.1; 52/748.1; 29/243.5; 29/243.57; 72/168

[58] Field of Search ..... 52/749.1, 748.1; 29/243.5, 243.57, 243.58; 72/210, 211, 168, 166, 173

[56] References Cited

U.S. PATENT DOCUMENTS

| | | | |
|---|---|---|---|
| 3,487,799 | 1/1970 | Gronlund | 29/243.57 |
| 3,528,167 | 9/1970 | Lipp | 29/243.5 |
| 3,797,430 | 3/1974 | Boudreau | 29/243.57 |
| 3,875,642 | 4/1975 | Knudson | 29/243.5 |
| 3,902,288 | 9/1975 | Knudson | 52/86 |
| 3,967,430 | 7/1976 | Knudson | 52/745 |
| 4,027,611 | 6/1977 | Ward et al. | 29/243.5 |
| 4,301,587 | 11/1981 | Boyd | 29/243.5 |
| 4,470,186 | 9/1984 | Knudson | 29/243.5 |
| 4,505,084 | 3/1985 | Knudson | 52/528 |
| 4,726,107 | 2/1988 | Knudson | 29/243.5 |
| 4,918,797 | 4/1990 | Watkins et al. | 29/243.5 |
| 4,989,308 | 2/1991 | Sanders | 29/243.5 |
| 5,249,445 | 10/1993 | Morello | 72/9 |

*Primary Examiner*—Carl D. Friedman
*Assistant Examiner*—Aimee E. McTigue
*Attorney, Agent, or Firm*—Rothwell, Figg, Ernst & Kurz

[57] ABSTRACT

A seaming device for connecting building panels in a continuous seam along adjacent side edges of two building panels in the construction of a building or like structure which is particularly suited for seaming panels with both curved and straight portions. The seaming device includes an intermediate set of rollers capable of moving vertically and thereby allowing the seamer to seam panels having both straight portions and curved portions. By allowing the intermediate rollers to move vertically, the seaming apparatus of the present invention "walks" along the panel much more easily and avoids causing damage to the paint of the panel. The vertical movement of the intermediate rollers permits the seamer to adjust to changes in the panel from straight to curved and curved to straight.

5 Claims, 6 Drawing Sheets

SEAMING DEVICE CAPABLE OF SEAMING CURVED AND STRAIGHT PANELS

BACKGROUND OF THE INVENTION

1. Field of the Invention

The invention relates to a novel seam-forming apparatus for connecting building panels in a continuous seam along adjacent side edges of two building panels in the construction of a building or like structure.

2. Prior Art and Background

It is known to construct continuous arch metal buildings with adjacent curved building panels which are seamed together at their adjacent edges. See e.g., U.S. Pat. No. 3,902,288.

In connection with seaming panels for such metal buildings, rotary seamer devices have been used. Such a device is disclosed, for example in U.S. Pat. Nos. 3,875,642 (which is hereby incorporated by reference as if fully set forth herein); 4,470,186 and 4,726,107. The rotary seamer devices connect or seam together the side edge portions of adjacent panels.

Each panel comprises a main portion from which the side edge portion extends vertically. A first panel includes an out turned side edge portion having an upwardly extending, outwardly turned flange portion and a down-turned terminal portion forming an inverted U-shaped channel. In other words, the first section extends upwardly from the panel, the second section extends outward laterally from the first section and a third section extends downward from the second section. A second panel includes an in-turned side edge portion having an inwardly turned flange portion disposed inside the U-shaped channel of the first panel. This in-turned side edge portion has a first section extending upwardly from the panel and a second section extending laterally inward from the first section. These sections of the second panel fit within the first and second sections of the first panel respectively. Such an arrangement is described, for example, in U.S. Pat. Nos. 3,967,430 and 4,505,084.

The panels themselves are generally curved but a panel may have both straight and curved portions. These building panels are described in U.S. Pat. No. 5,249,445 which relates to a method for forming arched roof, vertical walled self-supporting metal buildings.

Seamers such as those described in U.S. Pat. No. 3,875,642 are only capable of seaming either straight panel portions or curved panel portions. Such seamers are not able to seam panels that are both straight and curved. When attempting to utilize such a seamer on panels with both curved and straight portions, the seaming apparatus tends to "walk off" or dislodge from the seam particularly in transition areas when the panel changes from straight to curved or vice-versa. The dislodging causes damage to the panel and/or an improper seam.

SUMMARY OF THE INVENTION

The apparatus of the present invention includes a seaming device having an intermediate set of rollers capable of moving vertically and thereby allowing the seamer to seam panels having both straight portions and curved portions. By allowing the intermediate rollers to move vertically, the seaming apparatus of the present invention "walks" along the panel much more easily and avoids causing damage to the paint of the panel. The vertical movement of the intermediate rollers permits the seamer to adjust to changes in the panel from straight to curved and curved to straight. The adjustment by the seamer prevents it from dislodging from the building panels, particularly in the transition regions where the panel changes from a straight to a curved portion.

The seaming apparatus of the present invention can be utilized to seam panels having both straight portions and curved corner portions with a corner radius as low as 4 feet and as high as infinity.

The seaming apparatus of the present invention is appropriate for use in the construction of a building having straight walls and a tightly arched corner radius and a fuller radius large arch. This type of building is typically referred to as a straight wall dome building. Typical gages of metal used in the panels to form such a building are 0.025 to 0.045 structural quality, prepainted, galvanized steel. Typical spans of such structures range from 12 feet to 80 feet.

Another typical building panel of the type for which these seaming apparatus of the present invention are particularly suited consists of straight walled portions, tightly arched radius portions and a straight slanted portion having a very tight apex arched portion at the top. Buildings constructed with these shape panels are commonly referred to as a gable-type building having relatively straight sloping roof panels. The typical spans for buildings of this type are 12 feet to 80 feet using 0.025 to 0.045 structural grade, prepainted, galvanized steel.

In another aspect of the present invention, the intermediate rollers are mounted using hardened bearings which provides for smooth and trouble-free operation and a longer life for the seaming apparatus.

Other aspects, advantages and capabilities of the present invention will become apparent to those of ordinary skill in the art upon reviewing the following detailed description in conjunction with the accompanying drawings.

DETAILED DESCRIPTION OF THE PREFERRED EMBODIMENT

Figure 1:
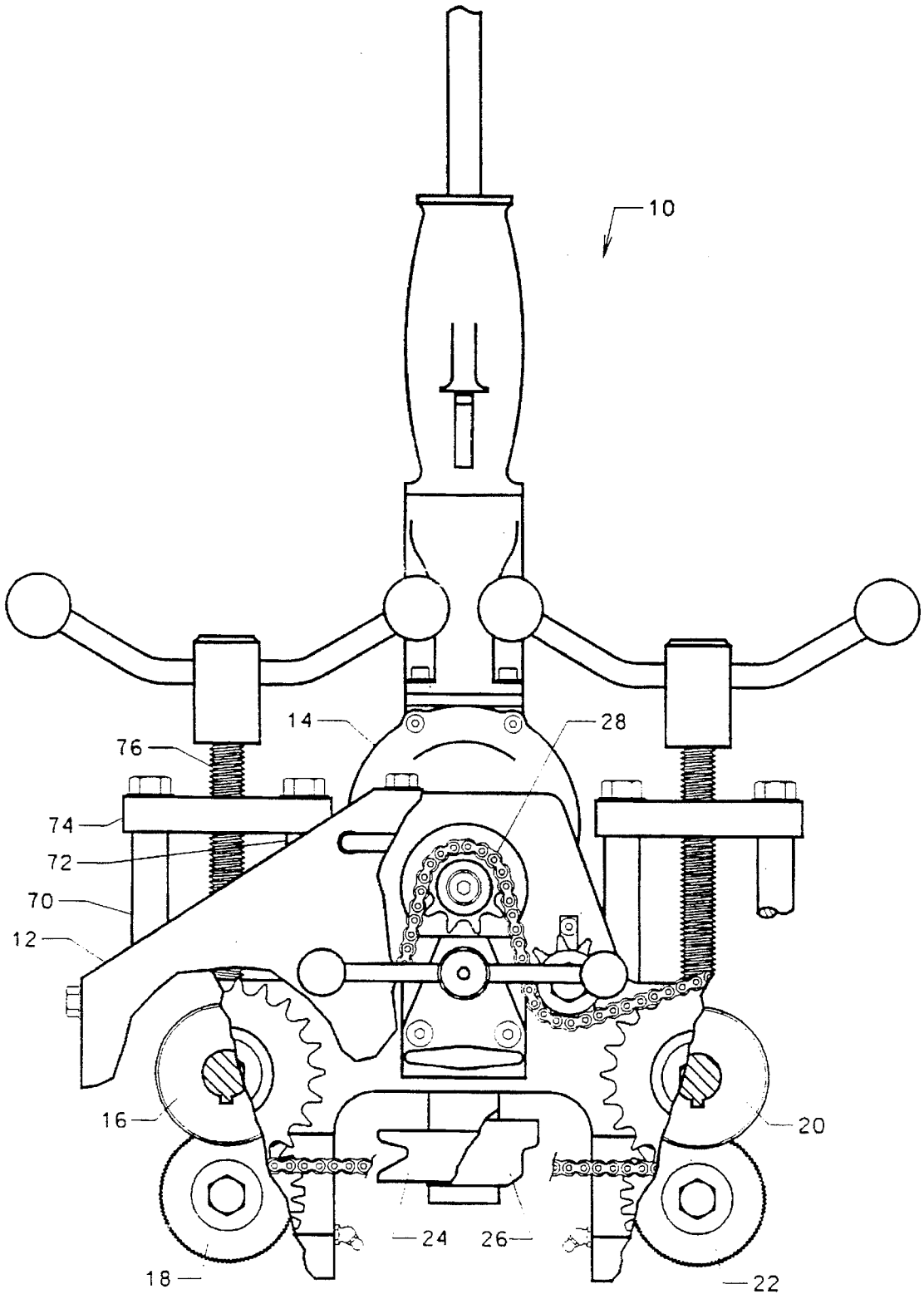
FIG. 1 is a side view of seaming apparatus embodying features of the present invention.

FIG. 1 shows a partial section and side elevation view of a seaming apparatus embodying aspects of the present invention. The seam-forming apparatus, generally indicated as 10, is comprised of a main support frame 12, a power source in the form of an electric gear motor 14 mounted on the support frame 12 and a panel-engaging assembly generally in the form of three sets of rollers. The three sets of rollers include upper power driven roller 16 and lower power driven roller 18, a second set of upper power driven roller 20 and lower power driven roller 22 axially spaced from the first set and a third intermediate set of laterally spaced (horizontally opposed) rollers 24 and 26 disposed between the other two sets. The electric motor 14 is coupled to the two sets of power driven upper and lower rollers in the normal manner via a gear and chain drive train designated generally as 28.

The upper power driven rollers 16 and 20 guide the seamer as it moves forward. The two bottom power driven rollers (also referred to as bottom drive rollers) 18 and 22 grip the panel in combination with the forming rollers 16 and 20 and drive the seamer along. The pair of horizontally opposed rollers 26 and 24 are the initial forming set of rollers and are capable of moving vertically along their axles independent of the other rollers.

Figure 2:
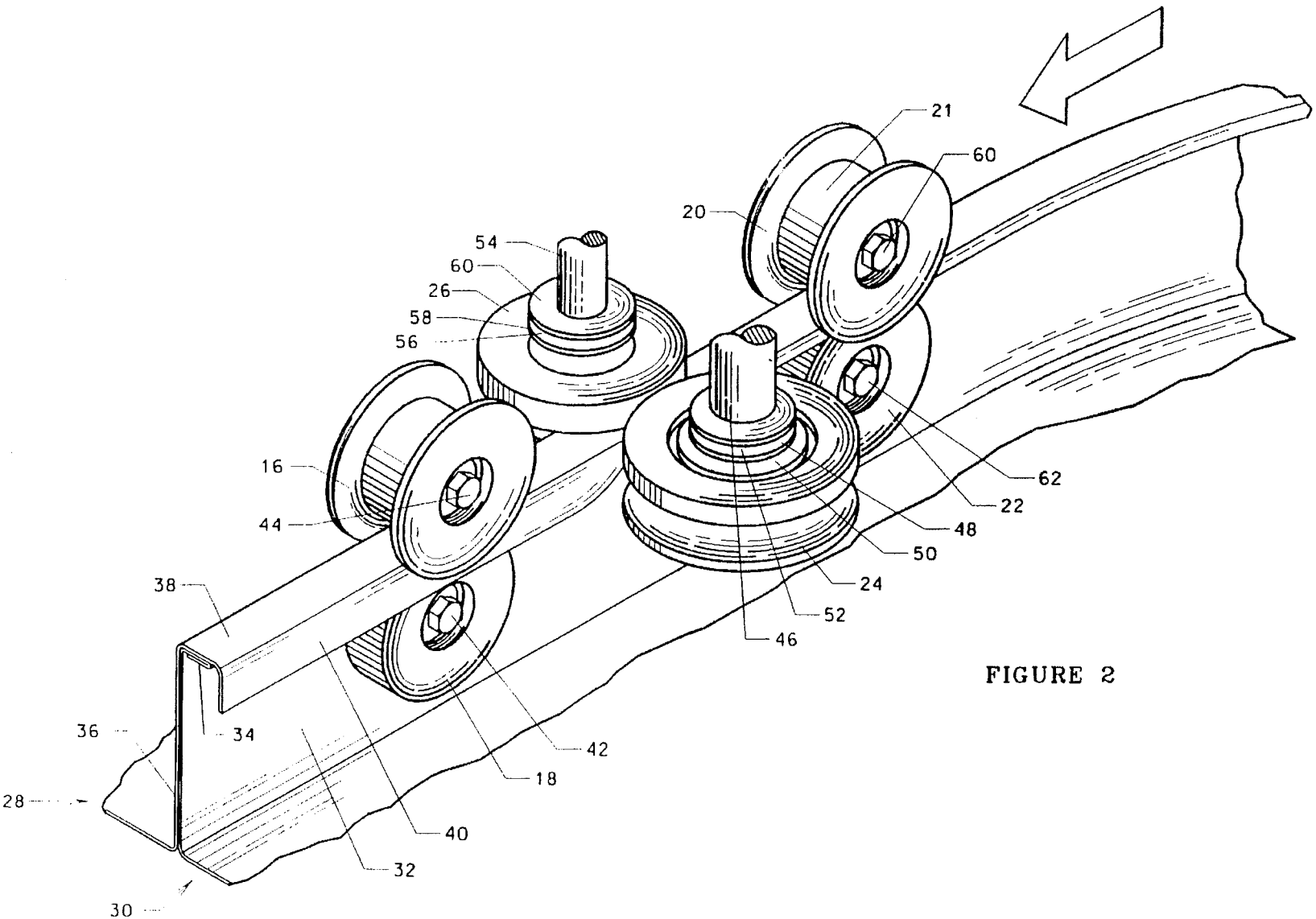
FIG. 2 is a fragmentary perspective view showing the arrangement of rollers in relation to two building panels being joined.

In FIG. 2, the edge portions of two building panels designated generally as 28 and 30 are shown. Building panel 28 includes a vertical portion 36, an outturned flange portion (horizontal portion) 38 and a down turned terminal portion (vertical edge) 40 which in combination form a U-shaped channel. Building panel 30 includes a vertical portion 32 and a top horizontal portion that is doubled over and is placed within the U-shaped channel prior to the seaming operation. Generally speaking, the seaming process involves turning vertical edge 40 under inturned flange portion (top portion) 34 to form a tight seam.

Each of the bottom drive rollers 18 and 22 are mounted for vertical adjustment relative to their associated upper roller 16 and 20 respectively. The bottom drive rollers are so mounted in a nearly identical manner. For purposes of brevity, only the mounting of the forward bottom drive roller 18 will be described. Bottom drive roller 18 is mounted using vertically adjustable bearing block in a well known manner utilizing slide rods 70 and 72 held apart by plate 74 (see FIG. 1). The lower ends of the slide rods being affixed to a bearing block (not shown) to which the roller 18 (22) is mounted by a shaft 42 (62). Threaded adjustment bolt 76 is threaded through plate 74 with the lower end of the adjustment bolt 76 resting against the main support frame (see FIG. 1). As the adjustment bolt 76 is turned in one direction, the bottom roller is raised and as the adjustment bolt 76 is turned in the other direction, the bottom roller is lowered.

To begin the seaming process utilizing the present invention, the seaming apparatus 10 is mounted in the normal manner on the panels to be seamed. After mounting the seaming apparatus 10, the bottom drive roller 18 is in firm frictional contact with the bottom side of the doubled over top portion 34 of panel 28. The bottom drive roller 18 is mounted to the main support frame 12 via a shaft 42. Upper forming roller 16 which guides the seamer along the seam being formed is also rotatably mounted to the main support frame 12 via a shaft 44.

Figure 5:
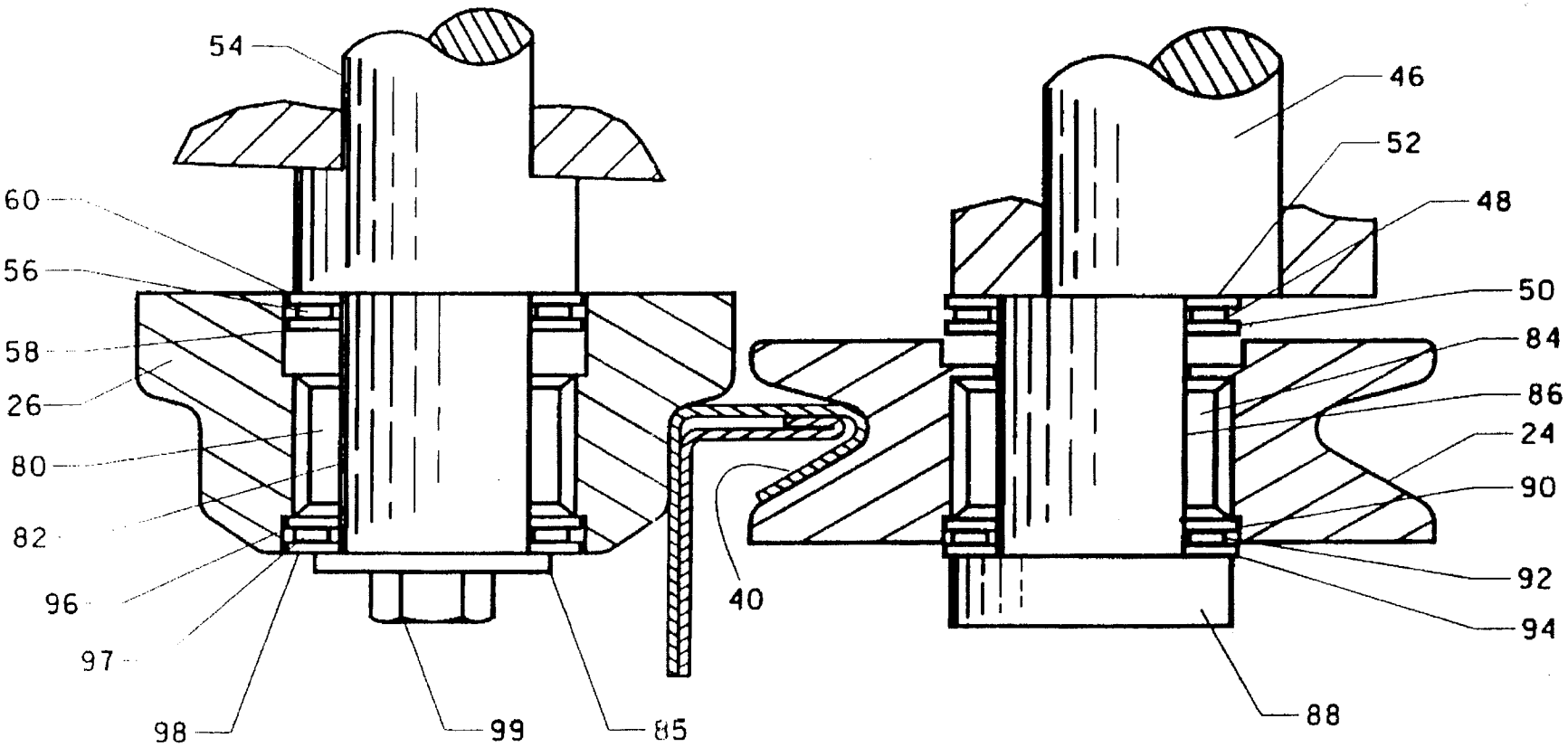
FIG. 5 is a detailed view of the intermediate horizontally opposed rollers.

Horizontally opposed roller 26 rides over horizontal edge 38 and vertical portion 36 (see FIG. 5). Horizontal roller 24 performs the major forming action upon vertical edge 40. Contact between horizontal roller 24 and vertical edge 40 forces vertical edge 40 inward towards vertical portion 36 essentially beginning the seaming process. Horizontal roller 24 is mounted to main support frame 12 via shaft 46. Bearing 86 (see FIG. 5) permits horizontal roller 24 to freely move in the vertical direction. Bearing 48 is encapsulated by bearing shim 50 and 52. Similarly, horizontal roller 26 is coupled to main support frame 12 via shaft 54. Horizontal roller 26 can move freely in the vertical direction upon bearing 80 which is encapsulated by bearing shims 58 and 60 (see FIG. 5).

In addition, horizontal roller 24 preferably includes a laterally movable axis arrangement as is described, for example, in U.S. Pat. No. 3,875,642. This arrangement allows roller 24 to be moved to an open position for ease of mounting the seaming apparatus on the panels and a closed position for the seaming process.

Figure 3:
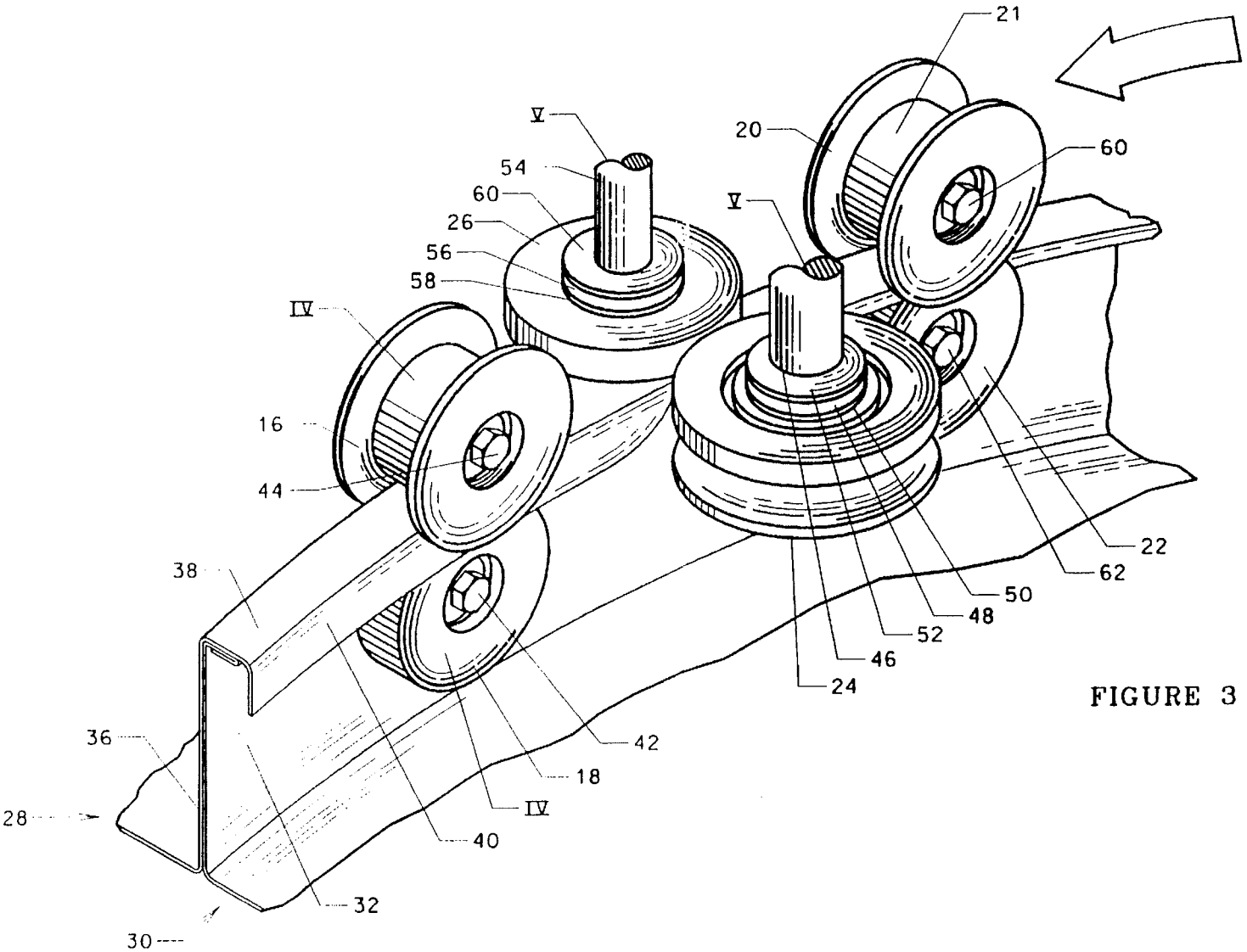
FIG. 3 is a fragmentary perspective view showing the arrangement of the rollers in relation to two curved building panels being joined.

FIG. 5 is a cut-away view taken along line V—V of FIG. 3 showing the horizontal rollers. The basic task of horizontal roller 26 is to ride the outside edge of vertical portion 36 to ensure that the seaming apparatus does not dislodge from the building panel. In addition, horizontal roller 26 can move vertically upward and is rotatably mounted to shaft 54. Roller 26 rotates through the combination of needle-bearing 80 which rotates about hardened inner ring 82. The needle roller-bearing 80 has a natural rolling motion which permits it to slide vertically upward along the hardened inner ring 82. When the seamer comes in contact with the portion of the panel having a tight radius of curvature, horizonal roller 26 is forced vertically upward by horizontal edge 38. Horizontal roller 26 then moves vertically upward against shim 58 which then causes needle-bearing 56 to come into rotation in shim 60 which limits the upward travel of roller 26.

Shim 96 pushes against needle bearing 97 and rides against shim 98 which is held in position by washer 85 and 99. The foregoing combination limits the downward vertical movement of roller 26.

Horizontal roller 24 can similarly move vertically on shaft 46. Needle bearing 84 allows the roller to move vertically on inner ring 86. Washer 88 has a set of bearings 90, 92 and 94 which operate in the same fashion as bearings 60, 56 and 58. Upward vertical movement of roller 24 is limited by contact with shim 50 which rotates needle bearing 48 which is held by shim 52. That combination of bearings allows the roller to rotate freely upon shaft 46 even at the extreme ends of its vertical travel without jamming or causing any damage to the shaft.

The seaming process is completed with the use of forming roller 20 and bottom drive roller 22. Forming roller 20 is rotatably mounted to the main support frame 12 via shaft 60. Bottom drive roller 22 is rotatably mounted to the main support frame 12 via shaft 62. Bottom drive roller 22 compresses vertical edge 40 flat against top portion 34, thereby completing the seaming process as the seaming process travels in the direction indicated by the arrow in FIG. 2. The outer surface 23 of bottom drive roller 22 essentially compresses vertical edge 40 and top version 34 against the inner surface 21 of forming roller 20.

FIG. 3 is similar to FIG. 2, but shows the rollers on a curved portion of the panels. On the curved portion of the panels, the horizonal rollers 26 and 24 can be seen to have moved vertically upward to account for the portion of the arch of the panels between the points defined by the forward set of rollers 16 and 18 and the rearward set of rollers 20 and 22. Roller 24 has moved vertically upward pushing shim 50 into bearing 48 which is held by shim 52. This movement of roller 24 allows the building panels to be seamed on a portion with a tight radius without causing any damage to the panel such as tearing or cracking of the portions of the panels being seamed or scratching of the paint. Roller 26 has also moved vertically upward which moves against shim 58 into bearings 56 which are held by shim 60. The vertical motion of rollers 24 and 26 is controlled by the panels themselves, particularly horizontal edge 2, vertical edge 3 where they come into contact with the two rollers.

Figure 4:
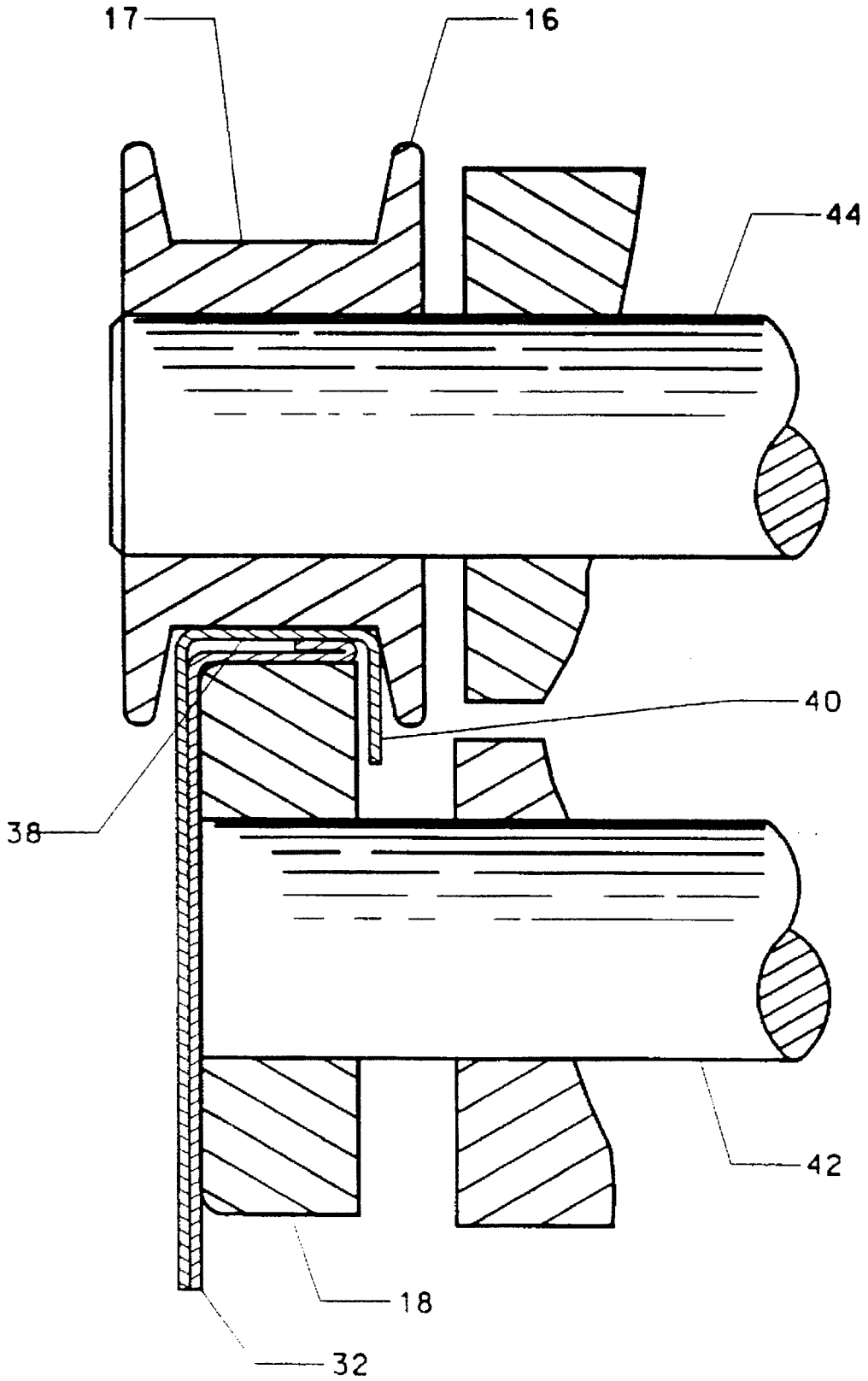
FIG. 4 is a detailed view of the front upper and lower power driven embodying aspects of the present invention.

FIG. 4 is a cross-sectional view taken along a section of line IV—IV shown in FIG. 3. Forming roller 16 surrounds horizontal edge 38 and thereby guides the seaming machine along the panels. Bottom roller 18 is a gripper roller which grips top portion 34 and horizontal edge 38 against the inner portion 17 of top roller 16. Bottom roller 18, which is driven by motor 14, propels the seaming apparatus along the panel.

Figure 6:
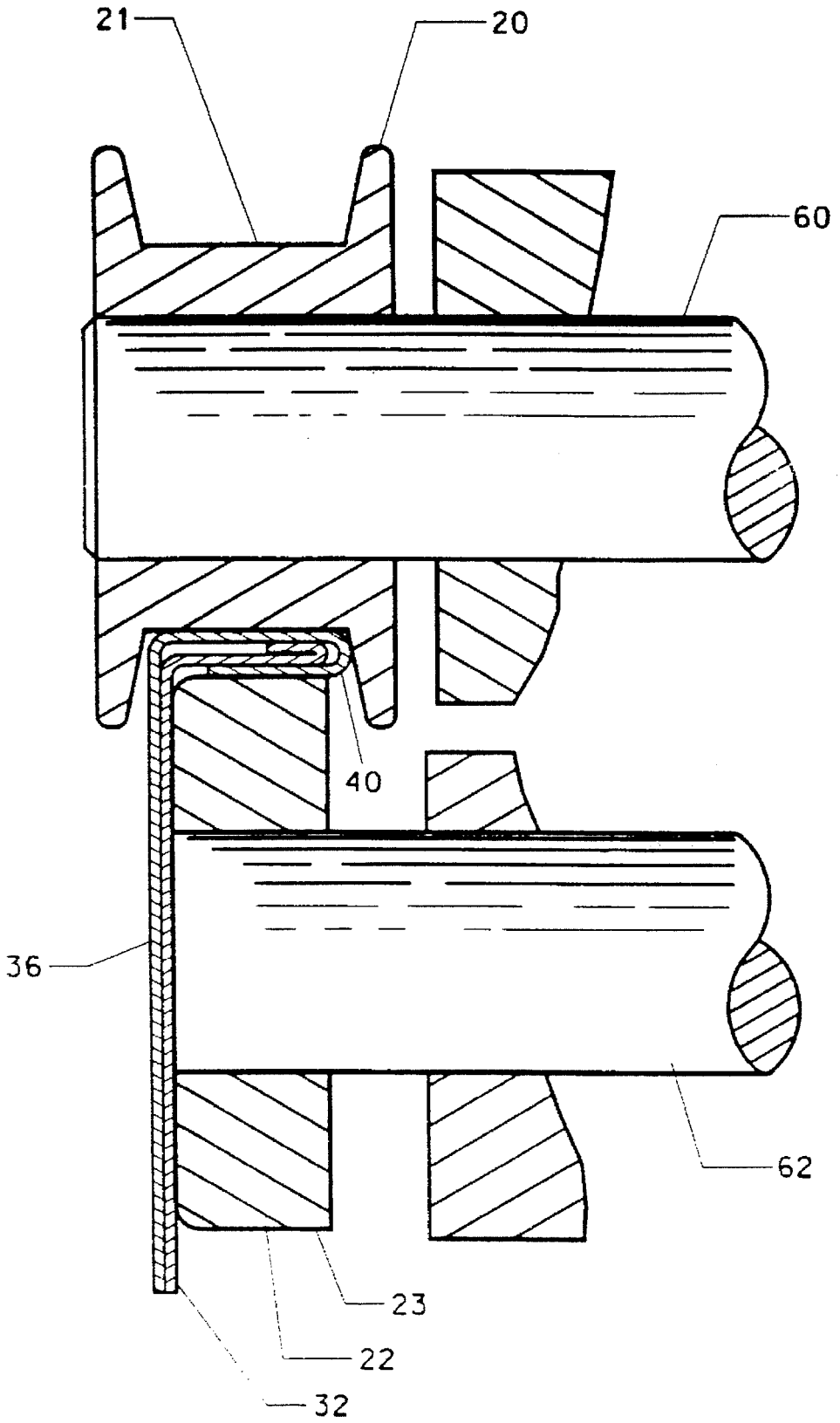
FIG. 6 is a detailed view of the rear upper and lower power driven rollers embodying aspects of the present invention.

FIG. 6 shows the final step of the seaming process. Rollers 20 and 22 operate in a manner nearly identical to that of rollers 16 and 18. Bottom roller 22 comes into contact with vertical edge 40 which was previously bent partially upward towards horizontal edge 38 by horizontal roller 24. Bottom roller 22 forces vertical edge 40 into contact with the top portion of 34 thereby encapsulating the seam.

Although the present invention has been described to a certain degree of particularity, it is to be understood that the present disclosure has been made by way of example and that changes of details of structure and operation may be made without departing from the spirit of the present invention.

What is claimed is:

1. A seaming apparatus for connecting a pair of adjacent panels, one of the panels having an outturned flange portion with a downturned terminal portion forming a U-shaped channel and the other of the panels having an inturned flange portion positioned in the U-shaped channel of the one panel, said seaming apparatus comprising:

a main support frame;

a drive motor mounted to said main support frame;

a first set of upper and lower vertically opposed rollers mounted for rotation to said main support frame, the lower roller of said first set capable of being positioned in the U-shaped channel and the upper roller of said first set capable of being simultaneously positioned above and in contact with the outturned flange portion, both of the rollers of said first set making engagement with respectively adjacent surfaces of the panels and at least one of the rollers of said first set being coupled to said drive motor by a drive train;

a second set of upper and lower vertically opposed rollers mounted for rotation to said main support frame and longitudinally spaced from said first set of upper and lower vertically opposed rollers, the lower roller of said second set capable of being positioned in the U-shaped channel and the upper roller of said second set capable of being simultaneously positioned above and in contact with the outturned flange portion, both of the rollers of said second set making engagement with respectively adjacent surfaces of the panels and at least one of the rollers of said second set being coupled to said drive motor by said drive train;

a set of first and second horizontally opposed rollers mounted for rotation in a plane to said main support frame between said first and second sets of upper and lower vertically opposed rollers, said set of first and second horizontally opposed rollers mounted for limited linear motion normal to their plane of rotation during seam-forming operation of said seaming apparatus, said set of first and second horizontally opposed rollers positionable such that said first horizontally opposed roller rides over the outturned flange portion opposite to the downturned terminal portion and such that said second horizontally opposed roller contacts the downturned terminal portion and bends the downturned terminal portion under the inturned terminal portion at an angle whereby said second set of upper and lower vertically opposed rollers flattens the angularly disposed downturned terminal portion against the underside of the inturned flange portion as said seaming apparatus is moved along the panels.

2. The seaming apparatus according to claim 1, wherein said first and second horizontally opposed rollers are rotatably mounted to respective shafts along which each said roller can also travel freely in a vertical direction, said shafts are mounted to said main support frame, and each of said first and second horizontally opposed rollers includes first bearing means at an end of the respective shaft to limit vertical travel of the roller in a downward direction, without impeding free rotation of the roller, and second bearing means spaced along the shaft from the end of the shaft to limit vertical travel of the roller in an upward direction without impeding free rotation of the roller.

3. A seaming apparatus for connecting a pair of adjacent panels, one of the panels having an outturned flange portion with a downturned terminal portion forming a U-shaped channel and the other of the panels having an inturned flange portion positioned in the U-shaped channel of the one panel, said seaming apparatus comprising:

a main support frame;

a first upper roller and a first lower roller vertically opposed to each other and mounted for rotation in a plane to said main support frame, said first lower roller capable of being positioned in the U-shaped channel and said first upper roller capable of being simultaneously positioned above and in contact with the outturned flange portion, both of said first upper roller and said first lower roller making engagement with respectively adjacent surfaces of the panels;

a second upper roller and a second lower roller vertically opposed to each other, mounted for rotation in a plane to said main support frame, and longitudinally spaced from said first upper and lower rollers, said second lower roller capable of being positioned in the U-shaped channel and said second upper roller capable of being simultaneously positioned above the outturned flange portion, both of said second upper roller and said second lower roller making engagement with respectively adjacent surfaces of the panels;

a set of first and second horizontally opposed rollers mounted for rotation, in a plane normal to the planes of rotation of said first and second upper and lower rollers, to said main support frame between said first upper and lower rollers and said second upper and lower rollers, each of said first and second horizontally opposed rollers having means for allowing linear motion normal to their plane of rotation during seam-forming operation of said seaming apparatus, said set of first and second horizontally opposed rollers positionable such that said first horizontally .Opposed roller rides over the outturned flange portion opposite to the downturned terminal portion and such that said second horizontally opposed roller contacts the downturned terminal portion and bends the downturned terminal portion under the inturned terminal portion at an angle whereby said second upper roller and said second lower roller flatten the angularly disposed downturned terminal portion against the underside of the inturned flange portion as said seaming apparatus is moved along the panels.

4. The seaming apparatus according to claim 3, wherein said means for allowing linear motion comprises a shaft mounted to said main support frame upon which one of said first and second horizontally opposed rollers is rotatably mounted, first bearing means at an end of said shaft for limiting travel of said roller away from said main support frame without impeding the ability of said roller to rotate about said shaft, and second bearing means located between said roller and said main support frame for limiting travel of said roller towards said main support frame without impeding the ability of said roller to rotate about said shaft.

5. A method for connecting a pair of adjacent panels having curved and straight portions, one of the panels having an outturned flange portion with a downturned terminal portion forming a U-shaped channel and the other of the panels having an inturned flange portion positioned in the U-shaped channel of the one panel, said method comprising the steps of:

providing a first set of upper and lower vertically opposed rollers with the lower roller of said first set positioned in the U-shaped channel and the upper roller of said first set positioned above and in contact with the outturned flange portion, both of the rollers of said first set making engagement with respectively adjacent surfaces of the panels;

driving a set of first and second horizontally opposed rollers along said panels, said set of first and second horizontally opposed rollers located between said first set of upper and lower vertically opposed rollers and a second set of upper and lower vertically opposed rollers, said first and second horizontally opposed rollers positioned such that said first horizontally opposed roller rides over the outturned flange portion opposite to the downturned terminal portion and such that said second horizontally opposed roller contacts the downturned terminal portion and bends the downturned terminal portion under the inturned terminal portion at an angle as said rollers are driven along said panels, said second set of upper and lower vertically opposed rollers longitudinally spaced from said first set of upper and lower vertically opposed rollers, the lower roller of said second set positioned in the U-shaped channel and the upper roller of said second set positioned above and in contact with the outturned flange portion, both of the rollers of said second set making engagement with respectively adjacent surfaces of the panels, allowing said first and second horizontally opposed rollers to adjust to changes in curvature of said panels by moving vertically relative to the direction in which they are being driven;

driving said second set of upper and lower vertically opposed rollers along said panels, behind said first and second horizontally opposed rollers, such that said second set of upper and lower vertically opposed rollers flattens the angularly disposed downturned terminal portion against the underside of the inturned flange portion as said sets of rollers are moved along the panels.

* * * * *